United States Patent [19]

Hawley et al.

[11] 4,248,019

[45] Feb. 3, 1981

[54] WORKPIECE CONDITIONING GRINDER CONTROL SYSTEM

[75] Inventors: Royal T. Hawley, Everett; John P. Veale, Kirkland; Jack L. Odell, II, Snohomish, all of Wash.

[73] Assignee: Western Gear Corporation, Washington, D.C.

[21] Appl. No.: 855,162

[22] Filed: Nov. 28, 1977

[51] Int. Cl.[3] ..... B24B 7/02

[52] U.S. Cl. ..... 51/45; 51/92 R; 51/165.77; 51/165.92; 51/35

[58] Field of Search ..... 51/33 R, 165.92, 34 D, 51/47, 165.75, 34 R, 34 C, 35, 45, 92 R, 92 ND, 165.77

[56] References Cited

U.S. PATENT DOCUMENTS

| | | | |
|---|---|---|---|
| 2,750,714 | 6/1956 | Mueling | 51/35 |
| 2,845,751 | 8/1958 | Woodward | 51/35 |
| 2,955,388 | 11/1960 | Lavner | 51/35 |
| 3,052,067 | 9/1962 | Dilks | 51/35 |
| 3,089,287 | 5/1963 | Dilks | 51/35 |
| 3,100,954 | 8/1963 | Di Lella | 51/165.77 |
| 3,118,254 | 1/1964 | Di Lella | 51/45 |
| 3,124,910 | 3/1964 | Dever et al. | 51/165.92 |
| 3,253,368 | 5/1966 | Vekouius | 51/33 R |
| 3,335,525 | 8/1967 | Mueling | 51/35 |
| 3,354,587 | 11/1967 | Janis, Jr. et al. | 51/35 |
| 3,589,077 | 6/1971 | Lenning | 51/165.92 |
| 3,667,165 | 6/1972 | McDowell et al. | 51/35 |
| 3,721,045 | 3/1973 | Wojcik | 51/35 |
| 3,877,180 | 4/1975 | Brecker | 51/165.92 |
| 3,906,681 | 9/1975 | Seidel | 51/165.92 |
| 4,014,142 | 3/1977 | Coes, Jr. | 51/165.92 |
| 4,100,700 | 7/1978 | Peirce et al. | 51/92 R |

FOREIGN PATENT DOCUMENTS

| | | | |
|---|---|---|---|
| 1912107 | 10/1969 | Fed. Rep. of Germany | 51/165.75 |
| 2143778 | 3/1972 | Fed. Rep. of Germany | 51/165.92 |
| 2051680 | 4/1972 | Fed. Rep. of Germany | 51/165.92 |

*Primary Examiner*—Harold D. Whitehead
*Assistant Examiner*—Bradford Adolphson
*Attorney, Agent, or Firm*—Seed, Berry, Vernon & Baynham

[57] ABSTRACT

An elongated metal workpiece such as a slab or billet is moved longitudinally beneath a grinding head by a reciprocating car mounted on an elongated track. The grinding head includes a rotating grinding wheel mounted at the end of a first arm which is pivotally secured to one end of a pivotally mounted second arm. A hydraulic actuator extending between the frame and the first arm controls the grinding force exerted by the grinding wheel on the workpiece. One end of the actuator is connected to an accumulator which provides a constant upward bias to the arm while the pressure in the other end of the actuator is varied in accordance with a pressure control signal. The pressure control signal is derived from both a calculated torque command indicative of the grinding force expected to produce a grinding torque corresponding to the torque command and a torque error signal which is a function of the deviation of actual torque from the torque command in order to maintain the grinding torque substantially constant. The car may be reciprocated so that the grinding wheel travels beyond the end of the workpiece with the hydraulic actuator being locked to hold the position of the wheel constant. The grinding force may be limited to a preset maximum by allowing hydraulic fluid to flow from the actuator to raise the grinder head as grinding force exceeds the limiting value.

9 Claims, 8 Drawing Figures

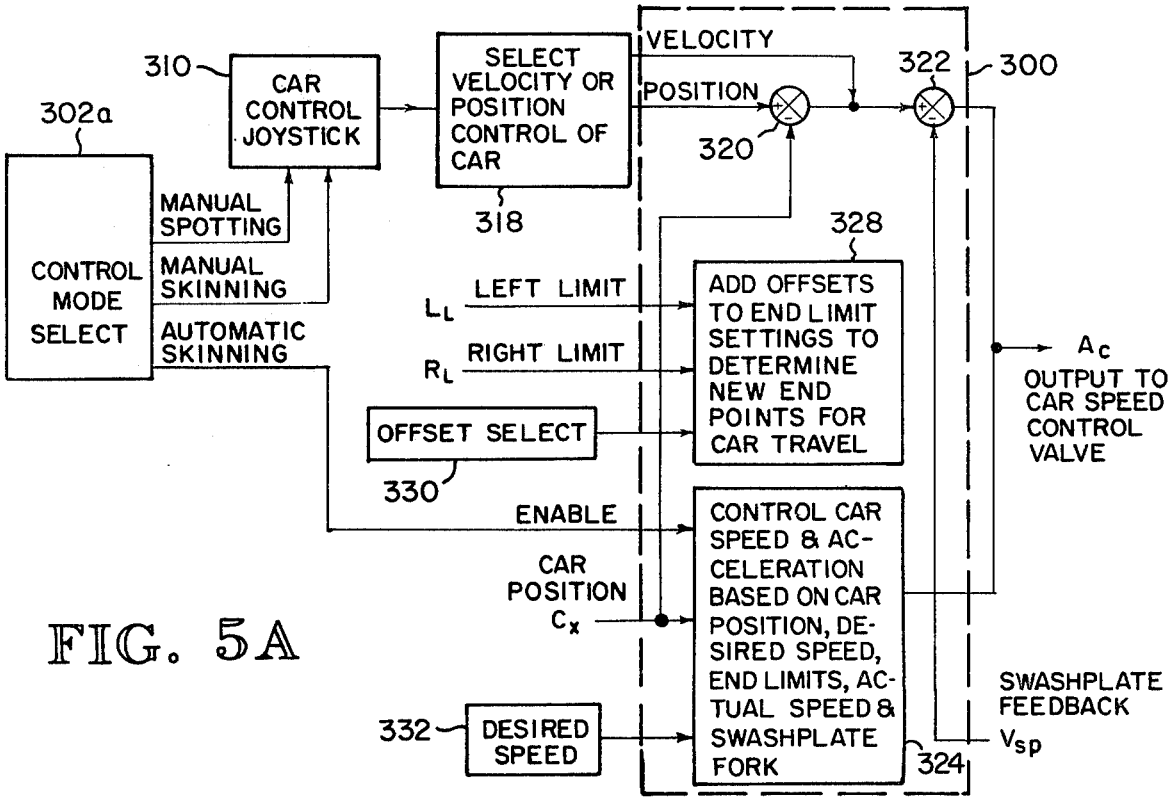
FIG. 5A
FIG. 5C
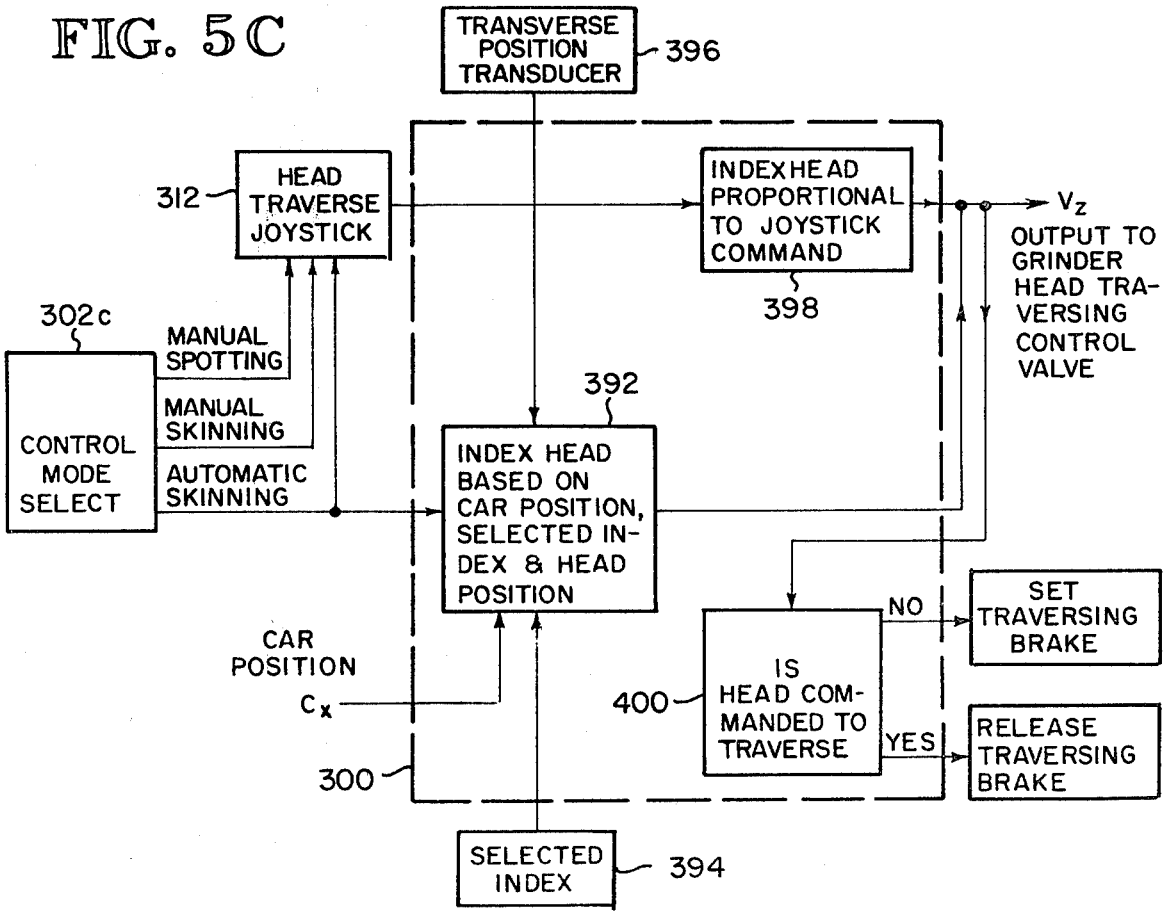

WORKPIECE CONDITIONING GRINDER CONTROL SYSTEM

BACKGROUND OF THE INVENTION

1. Field of the Invention

This invention relates to metal grinding machines and more particularly to a grinding machine for automatically or manually removing a surface layer of material from elongated metal workpieces in preparation for a subsequent operation.

2. Description of the Prior Art

Semi-finished, elongated workpieces such as steel slabs or billets are invariably coated with a fairly thin layer of oxides or other impurities which may extend into the billet a considerable distance, and defects consisting usually of longitudinal cracks at localized points on the surface of the billets. These impurities must be removed before the billets are rolled into finished products since the impurities and defects would otherwise appear in the finished product. Cracks particularly must be removed as subsequent operations invariably enlarge them. Billet grinders utilizing a reciprocating car for moving the billet longitudinally beneath a rotating grinding wheel or for moving the grinding wheel longitudinally above the billet have long been used to perform these functions. The relatively thin layer is removed by a "skinning" procedure in which the billet reciprocates beneath the grinding wheel with the grinding wheel moving transversely after each reciprocation or grinding pass until the entire surface of the billet has been covered. Relatively deep impurities and defects are then visually apparent, and they are removed by a "spotting" procedure in which the grinding wheel is held in contact with the localized area until all of the impurities have been removed.

Various techniques have been devised to automate the skinning procedure by automatically reciprocating the billet beneath the grinding wheel and moving the grinding wheel transversely an incremental distance each grinding pass until the entire surface has been covered. The basic problem with these systems has been their inability to remove a constant depth of material at a rapid rate particularly from non-straight workpiece surfaces thus either severely limiting the speed at which workpieces are conditioned or removing an excess quantity of metal from workpieces. These problems are principally due to excessive wheel vibration caused by wear resulting from exposure of the sliding ways to an abrasive environment and the use of control systems having a relatively slow response time which are thus incapable of responding to irregular workpiece surfaces at a sufficient rate.

One very sophisticated, microprocessor based grinding system is disclosed in U.S. patent application Ser. No. 748,293, now U.S. Pat. No. 4,100,700 issued July 18, 1979. Basically, this system computes the power required to produce a predetermined depth of cut of a predetermined width at a given car velocity. The calculated power is then compared with the actual rotational velocity of the grinding wheel to derive a torque command which is compared to the actual motor torque to produce a control signal for raising and lowering the grinding wheel from the workpiece.

Although grinding systems have been used which attempt to maintain the grinding pressure substantially constant, they have not proved satisfactory in actual use. These prior art systems generally utilize fairly light grinding heads which tend to vibrate excessively with detrimental effects upon wheel wear and life. Use of massive grinding heads has not been possible because conventional closed loop control techniques for controlling the grinding force are unable to operate with massive heads without excessive phase shifts which may cause the system to become unstable under certain conditions.

SUMMARY OF THE INVENTION

It is an object of the invention to provide a grinding machine capable of high production throughput at relatively high efficiency.

It is another object of the invention to provide a grinding machine which is capable of maintaining a constant grinding action with relatively little grinding wheel vibration.

It is still another object of the invention to provide a grinding machine which uniformly removes material from the surface of workpiece so that the ends of the workpiece are not tapered inwardly.

These and other objects of the invention are accomplished by a grinding machine having a fast response time control system for controlling the grinding force of a grinding head against the elongated workpiece so that the system is capable of removing a uniform depth of material at a rapid rate. The workpiece is carried by a car which automatically reciprocates between two semi-automatically or automatically selected limits. The grinding force is adjusted to maintain the grinding action substantially constant. Accordingly, the grinding force is proportional to the sum of a calculated command indicative of the grinding force expected to produce a preset grinding action and an error signal indicative of the deviation of actual grinding action from the preset grinding action. The actual grinding force is determined by measuring the lifting force imparted to a grinding wheel support arm by a hydraulic actuator. The hydraulic actuator includes a cylinder connected to the grinding frame and a piston slidably received in the cylinder having a piston rod connected to the support arm. The lower end of the cylinder is connected to an accumulator which maintains a preset upward bias on the arm while the pressure in the upper end of the cylinder is varied to adjust the grinding force. A pressure transducer in the accumulator measures the hydraulic pressure in the lower end of the cylinder while a pressure sensor in the upper end of the cylinder measures the pressure in the upper end of the cylinder. The grinding force is then calculated from the pressure differential between the upper and lower ends of the cylinder. Alternatively, in a pressure limit mode the system may be utilized to limit the maximum grinding force to a predetermined value. Accordingly, the hydraulic fluid in the upper portion of the cylinder may be connected to a return line whenever the pressure in the upper portion of the cylinder exceeds a predetermined value until the pressure returns to the predetermined value at which time communication between the cylinder and return line terminates. The delays associated with the hydraulic system in the pressure limit mode cause the grinding force to oscillate about the predetermined value while allowing the grinding wheel to accurately follow irregular contours of the workpiece. The workpiece may reciprocate so that the grinding wheel travels beyond the ends of the workpiece in which case fluid communication from the upper portion of the cylinder is prevented so that the vertical position of the grinding wheel is maintained substantially constant.

BRIEF DESCRIPTION OF THE FIGURES OF THE DRAWING

FIG. 5A is a schematic and block diagram of the car control system for the grinder.

FIG. 5C is a schematic and block diagram of the grinding head transverse axis control system for the grinder.

DETAILED DESCRIPTION OF THE PREFERRED EMBODIMENTS

Figure 1:
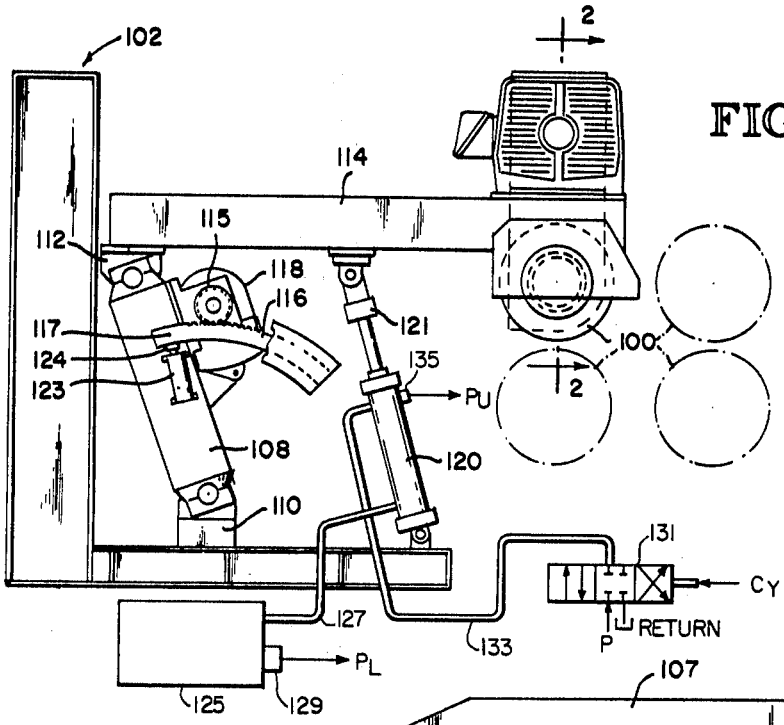
FIG. 1 is a cross-sectional view of the grinder system taken along the line 1—1 of FIG. 3.
Figure 2:
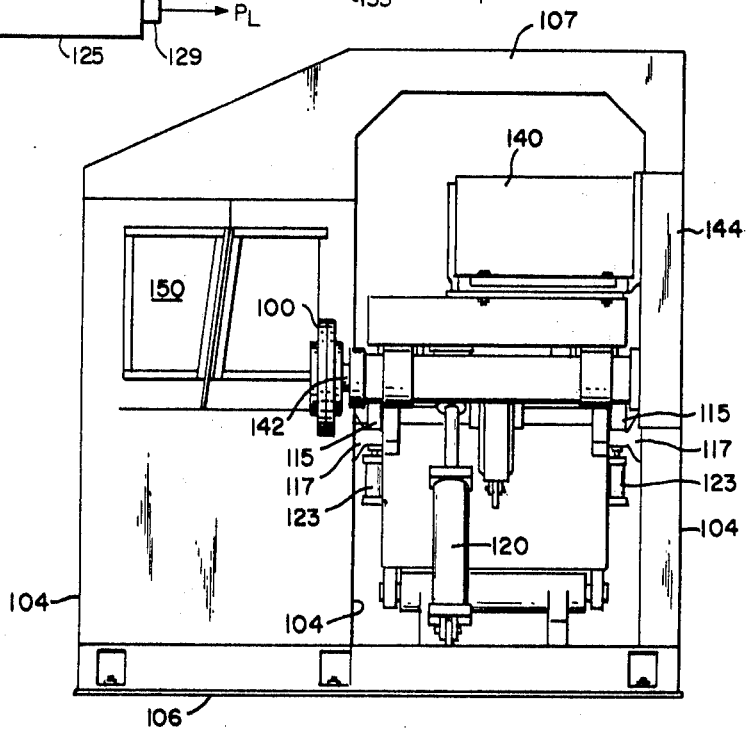
FIG. 2 is a cross-sectional view of the grinder system taken along the line 2—2 of FIG. 1.
Figure 3:
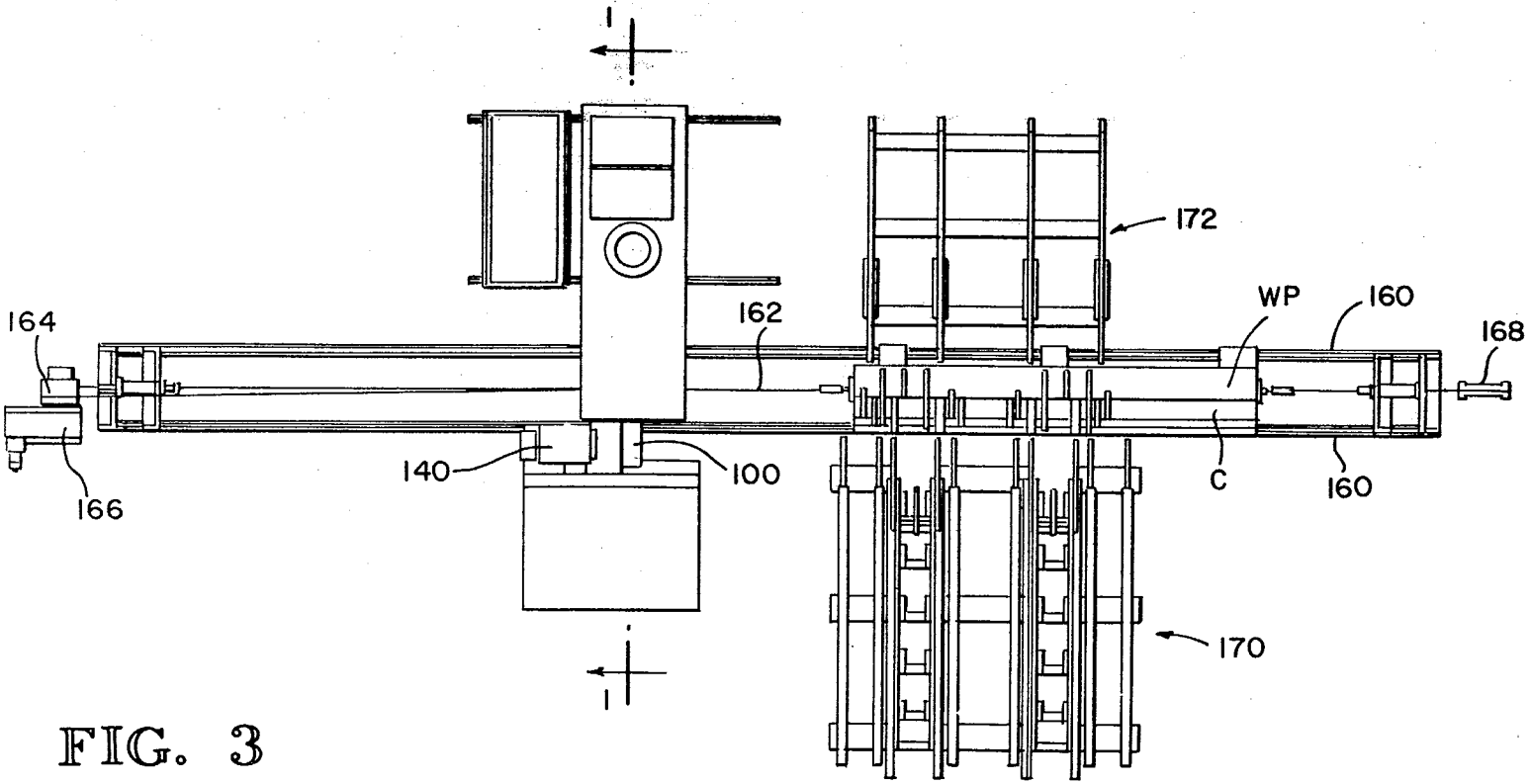
FIG. 3 is a top plan view of the grinder system including a car for supporting the workpiece and charge and discharge tables for loading the workpiece on and off the car.

One embodiment of a grinding apparatus including the means for moving the grinding wheel 100 is best shown in FIGS. 1–3. The apparatus includes a stationary, rigid frame 102 comprised of massive side frame members 104, a floor frame 106 and a roof frame 107. The side frames 104 are preferably formed from a conventional laminated concrete construction filled on site to provide a weight in excess of 60,000 pounds such that the massive weight of the frame provides extreme rigidity to the side frame members.

Positioned between two side frame members is a pivotal support 108 which is pivotally mounted to a bracket 110 rigidly connected to the bottom frame 106. The upper end of the pivotal support is connected to a bracket 112 that is rigidly connected to a pivotal arm 114. The opposite end of the pivotal arm 114 mounts the grinding wheel 100. The pivotal support 108 is positioned by a hydraulically driven set of pinion gears 115 that mesh with rack gears 116. The rack gears 116 lie on an arc coincident with the arc of movement of the pivotal support 108 and are connected to rigid side bars 117 that are connected to the massive side frame members 104. Rotation of the reversible hydraulic motor 118 will move the pinions along the racks to position the arm 108 and thus position the driving head transversely across a workpiece WP carried on a movable car C. The pinion gears 115 and motor 118, along with electronic and hydraulic control circuitry explained hereinafter, thus form a transverse actuating means for moving the grinding wheel transversely across the workpiece WP. Alternatively, the arm 108 may be positioned by a conventional hydraulic actuator. It will be understood that the inventive control system may be employed with a variety of grinding equipment and grinder frames in addition to the embodiment illustrated in FIGS. 1–3.

The vertical movement of the rotary head 100 is controlled by an hydraulic cylinder 120 pivotally connected to a fixed anchor formed by the base frame 106 and having a piston rod 121 that is pivotally connected to the pivotal arm 114 approximately at its midpoint. The piston rod 121 is connected to a piston (not shown) which divides the cylinder 120 into upper and lower sections. The lower section is connected by a fluid port to an accumulator 125 through a conduit 127 which communicates with the interior of the cylinder through a fluid port. The accumulator 125 acts as a bias means to maintain the pressure in the lower section of the cylinder 120 substantially constant to provide a constant upward bias to the grinding wheel 100. The pressure in the accumulator 125 is measured by a coventional pressure sensor 129 which produces a pressure signal $P_L$ proportional thereto. The upper section of the cylinder 120 is connected by a fluid port to a servo valve 131 is a hydraulic fluid control means which through piping 133 which communicates with the interior of the cylinder through a fluid port. The servo valve 131 is selectively actuated by a control signal $C_Y$ to either bleed hydraulic fluid from the upper section of the cylinder 120 thereby raising the grinding wheel 100 or to allow pressurized fluid to flow at a variable flow rate into the upper section of the cylinder 120 thereby lowering the grinding wheel 100. In its neutral, unenergized position the servo valve 131 prevents the flow of hydraulic fluid either into or out of the cylinder 120. The pressure in the upper section of the cylinder 120 is measured by an internal pressure transducer 135 which produces a pressure feedback signal $P_U$ indicative of the pressure in the upper section of the cylinder 120. The difference in pressure signals $P_L$-$P_U$ is proportional to the lifting force of the cylinder 120 and inversely proportional to the grinding force when the wheel is in contact with the billet. The pressure transducer 135, by measuring the pressure in the upper section of the cylinder 120, is a pressure sensing means which produces a pressure feedback signal indicative of the force of the grinding wheel 100 against the workpiece. The combined movements of the hydraulic motor 118 and the hydraulic cylinder 120 can position the grinding wheel 100 in an infinitely variable number of positions such as shown by the phantom lines drawings in FIG. 1.

It is an important feature of this embodiment of the invention that the grinding head be extremely well dampened to reduce vibration. Conventional billet grinders, for example, are mounted on guideways or other linkage mechanisms and over prolonged use in the highly abrasive dust environment become quite sloppy in their connections allowing the grinding head to vibrate on the workpiece. It is estimated that the efficiency of present day conditioning grinders, for example, is between 20° and 30% of ideal.

Vibration is considered to be one of the largest problems causing limited grinding wheel life and substandard surface finishes on the workpiece. Also, vibration tends to be one of the major causes of structural deterioration of the grinding wheel itself. In this embodiment of the invention, rigid, massive structural design and vibrational dampening construction reduces the vibrations to a minimum. By reducing vibration the grinding wheel can be maintained in contact with the billet for a longer period through each revolution. This will result in more horsepower being transferred effectively to the grinding process at any specific grinding head load. The reduction of vibration maintains a proportionately rounder wheel during the life of the grinding wheel. The optimized contact time permits faster traverse speeds by the workpiece and increases wheel life by the reduction of shock load and excessive localized heating.

In order to reduce vibration the pivotal support 108 is locked directly to the side frame members during each grinding pass so that the pivotal arm pivots directly from the side frame in the grinding mode rather than through the motion connections of the traversing pivotal support 108. For this purpose the pivotal support has rigidly connected therewith a pair of locking cylinders 123. The locking cylinders are provided with clamping piston rods 124 that engage the underside of the side bars 117. An alternative locking mechanism, such as caliper disc braking mechanism, may also be used. When the locking cylinders 123 are actuated, the pivotal support 108 becomes rigidly connected to the side frame members 104 at its side surfaces rather than solely through its pivotal connection on the bracket 110. Thus the pivotal connection to the bracket 110 becomes isolated and does not enter in as an extended connection which can provide vibration motion to the grinding head. The rigidifying of the pivotal connection for the pivotal arm 114 also provides the further advantage of having faster response time for movements of the grinding head in response to changes in variations of the surface of the workpiece since the only motion possible to the grinding head is in a single direction. With motion occurring in two axes, one of which being the traversing mechanism, such as in conventional grinders non-linear errors arise in the control forcing a response rate to be slowed in order to maintain accurate control of the position and pressure of the grinding wheel. The grinding head is preferably powered by an electric motor 140 that drives a spindle 142 through a gear train 144. Preferably the grinding wheel is cantilevered out to one side so that it is directly visible by an operator at a viewing window 150.

The overall grinder machine including the longitudinal actuating means for reciprocating the workpiece WP is best illustrated in FIG. 3. The workpiece WP is supported on a conventional car C having a set of wheels (not shown) which roll along a pair of elongated tracks 160. As illustrated in FIG. 3, the workpiece is elongated and it thus inherently has a longitudinal axis extending from one end of the workpiece WP to the other. A cable 162 connected to one end of the car C engages a drum 164 which, as explained hereinafter, is selectively rotated by a hydraulic motor 166 or hydrostatic drive which is driven by a servo valve controlled hydraulic pump 167. The cable 162 then extends beneath the car C and engages a freely rotating sheave 168 at the other end of the track 160 and is then secured to the opposite end of the car C. Thus rotation of the drum 164 moves the car C along the track 160.

In operation, a workpiece such as a billet is initially placed on a conventional charge table 170. The car C is then moved along the track 160 to a charging position adjacent the charge table 170 and the workpiece is loaded onto the car C by conventional handling means. The car C then moves toward the grinding wheel 100 and the grinding wheel 100 is lowered into contact with the workpiece WP. The workpiece WP then reciprocates beneath the grinding wheel 100 for a plurality of grinding passes with the grinding wheel moving transversely across the workpiece an incremental amount for each reciprocation until the entire surface of the workpiece WP has been ground. The car C is finally moved to a discharge position where the workpiece WP is loaded onto a conventional discharge table 172 by conventional handling means.

As explained hereinafter, the grinding machine may be operated in one of four modes. In an "auto skinning" mode the car automatically reciprocates beneath the grinding wheel 100 with the vertical position of the grinding wheel being automatically controlled to follow the surface contour of the workpiece. After each longitudinal movement of the workpiece, the grinding wheel 100 is moved transversely to the longitudinal axis of the workpiece WP a small increment unless overridden manually until the entire surface of the workpiece has been ground. Conventional workpiece manipulating mechanisms on the car C then rotate the workpiece to allow the grinding wheel 100 to condition each of the surfaces. The finished workpiece is then delivered to the discharge table 172, and the car C receives a new workpiece from the charge table 170. The automatic skinning mode may only be selected if the workpiece left and right end limits have been set so that the car is capable of automatically moving between the left and right end limits. The grinding torque is controlled as a function of car speed by adjusting the grinding force in order to maintain a uniform depth-of-cut.

In a "manual skinning" mode the movement of the car C and the transverse movement of the grinding wheel 100 are manually controlled by the operator. However, the vertical position of the grinding wheel 100 and the grinding torque are automatically controlled in accordance with the velocity of the car C in order to maintain a uniform depth-of-cut along the length of the workpiece WP.

In a "manual spotting" mode the vertical position of the grinding wheel 100 and the grinding torque exerted on the grinding wheel 100 as well as the car movement and transverse position of the grinding wheel 100 are manually controlled by the operator. The automatic and manual skinning modes are utilized to remove the scale and shallow imperfections from the surface of the workpiece, while the manual spotting mode is utilized to remove relatively deep imperfections in the workpiece prior to a roller operation.

In a "standby" mode the grinding wheel is lifted from the workpiece a predetermined distance and car movement terminates.

Figure 4:
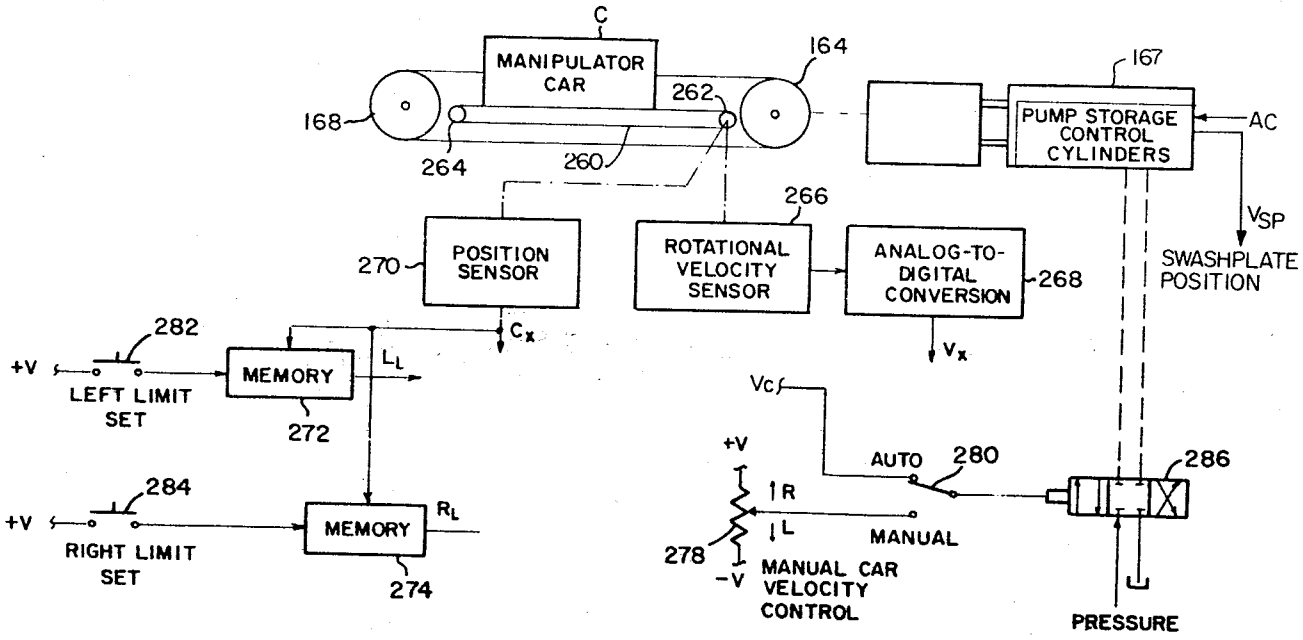
FIG. 4 is a schematic and block diagram of one embodiment of a car drive control system.

One embodiment of a car drive control system for moving the car C along the track 160 is illustrated in FIG. 4. A measurement cable 260 extends from on end of the car C, engages a sheave 262 at one end of the rails 160 (FIG. 3), extends along the rails 160 beneath car C to engage a sheave 264 at the opposite end of the rails 160, and is secured to the opposite end of the car C. The sheave 262 rotates a rotational velocity sensor 266, such as a tachometer, which is converted to a digital indication $V_X$ indicative of the rotational velocity of the sheave 262, and hence the linear velocity of the car C, by a conventional analog to digital conversion device 268. The sheave 262 also rotates a digital position sensor 270, such as a conventional encoder, which produces a digital position indication $C_X$. Alternately, a rack mounted on the car C may rotate a pinion gear which in turn drives the velocity sensor 266 and the position sensor 270. The position indication $C_X$ is applied to a pair of memory devices 272, 274. In operation the car C may be manually moved so that the grinding wheel 100 is adjacent the left end of the workpiece WP by actuating a manual car velocity control potentiometer 278 when a mode select switch illustrated hereinafter is in the manual position. A left limit set switch 282 is then actuated causing the current position indication $C_X$ to be read into the memory 272. The car C is then moved to the left by actuating potentiometer 278 until the grinding wheel 100 is adjacent the right edge of the workpiece WP at which point a right limit set switch 284 is actuated to read the current value of the car position indication $C_X$ into the memory device 274. Thus the positions of the car C for the left and right limits of travel are retained in memory devices 272, 274, respectively. As explained hereinafter, these limits are processed along with the position indication $C_X$ to generate a car velocity command which is applied to a servo valve 286 when the mode switch is in its automatic position. When the car reaches one limit value, the left end of the workpiece for example, the position of the car $C_X$ is equal to the left limit $L_L$, thereby causing the grinder control system to move the car to the left. When the grinding head is adjacent to the right edge of the workpiece WP and $C_X$ is equal to $L_L$ the car C is moved to the right. Because of the large mass of the car, the car C beings to decelerate before reaching the preset end limit. The deceleration point is calculated as a function of car speed and position. The servo valve 286 allows hydraulic fluid to flow into the hydraulic motor 166 to rotate the capstan 164 in either direction.

The hydraulic pump 167 is a commercially available product which contains a plurality of cylinders in a cylinder barrel each receiving a piston which reciprocates responsive to rotation of the cylinder barrel which is driven by a conventional rotational power source such as a motor. Each piston in turn bears against a swash plate. When the swash plate is in neutral or perpendicular to the axis of rotation of the barrel, rotation of the barrel does not cause the pistons to reciprocate so that hydraulic fluid is not pumped from the hydraulic pump 167 to the hydraulic motor 166. As the swash plate moves from a neutral position, rotation of the cylinder barrel causes the pistons to pump hydraulic fluid to the motor 166 thereby rotating the capstan 164. The pump 167 is typically provided with a transducer for sensing the angle of the swash plate and for producing a signal $V_{SP}$ indicative of the swash plate angle. This signal $V_{SP}$ is thus proportional to the rate at which hydraulic fluid passes through the hydraulic motor 166 which, in turn, is proportional to the velocity of the car C.

Figure 5B:
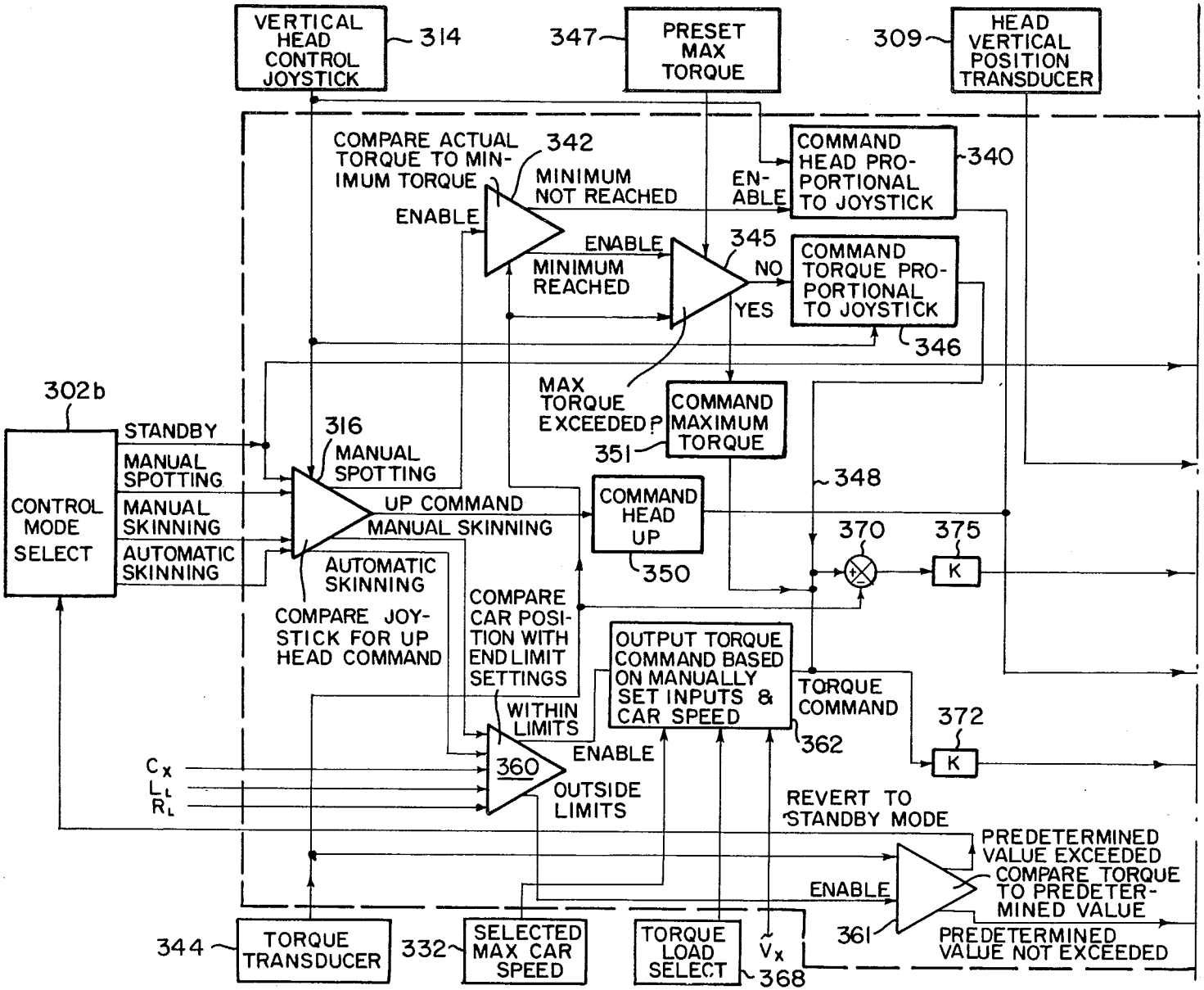
FIG. 5B is a schematic and block diagram of the grinding head vertical axis control system for the grinder.
Figure 5B:
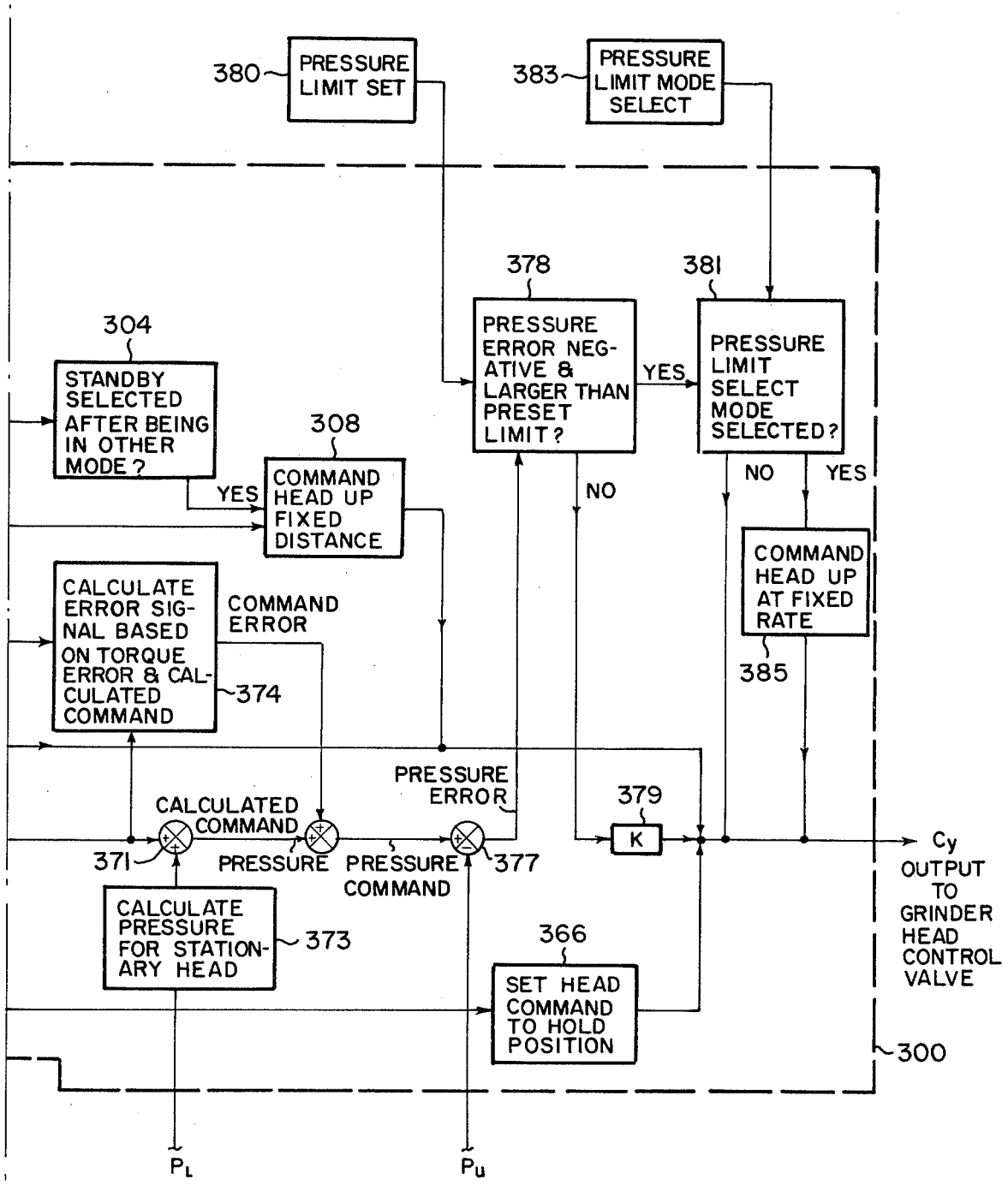

A block diagram for the grinder control system is illustrated in FIG. 5. It will be understood that the system may be implemented in a variety of ways including either standard, commercially available hardware circuitry or by appropriately programming a conventional microprocessor. For purposes of illustration, the system illustrated in FIG. 5 utilizes a microprocessor 300 which includes such hardware as a central processing unit, program and random access memories, timing and control circuitry, input-output interface devices and other conventional digital subsystems necessary to the operation of the central processing unit as is well understood by those skilled in the art. The microprocessor 300 operates according to a computer program produced according to the flow chart enclosed by the indicated periphery of the microprocessor 300.

One of the operating modes, namely, either the standby, manual spotting, manual skinning or automatic skinning modes, is selected by a control mode select switch 302. In the standby mode the system determines if the switch 302 is being switched to the standby mode from another mode at 304 (FIG. 5B) and causes the grinder head to be raised by actuating circuit 308. Circuit 308 applies an appropriate signal to the grinder head control valve output $C_Y$. In the manual spotting and manual skinning modes, a car control "joy stick" 310 (FIG. 5A) is enabled and in the manual spotting and manual skinning modes a head traverse joy stick 312 (FIG. 5C) is enabled. A head control joy stick 314 is continuously enabled, but its outputs are only utilized in the manual spotting and standby modes except when the head is commanded to lift. The joy sticks 310, 312, 314 are basically potentiometers having a resistance which varies in accordance with the position of a handle.

The outputs of the control mode select switch 302 are used to enable various circuits used in the system depending upon the operating mode selected. With reference to the block diagram for the car control system of FIG. 5A, the car control joy stick 310 is enabled in the manual spotting and manual skinning modes. The output of the car control joy stick 310 is a manipulation signal which is applied to a car control mode switch 318. The mode switch 318 selects either a velocity mode or a position mode depending upon the position of the switch 318 which may be mounted on the joy stick 310. In the position mode the position of the car is moved to the right or left in proportion to the manipulation signal which is, in turn, proportional to the position of the joy stick 310. Thus when the joy stick is moved to the left a predetermined distance the car moves to the left a predetermined distance, and when the joy stick is returned to its neutral position, the car returns to the original position. In the velocity mode, the velocity of the car C in either the right or left direction is proportional to the manipulation signal which is, in turn, proportional to the position of the joy stick 310 in either the right or left position, respectively. In the position mode the manipulation signal from the car control joy stick 310 is applied as a position output to a first summing junction 320 acting as a first comparator means, while in the velocity control mode the manipulation signal from the car control joy stick 310 as a velocity output is applied to a second summing junction 322, acting as a comparator means. The negative input of the summing junction 320 receives the car position feedback signal $C_X$ (FIG. 4) so that the output of the summing junction 320 is a position error which is proportional to the difference between the manipulation signal from the joy stick 310 and a signal $C_X$ indicative of the actual position of the car. The negative input of the summing junction 322 receives the signal $V_{SP}$ from the swash plate angle transducer which is proportional to the velocity of the car. Thus the output of summing junction 322 in the velocity mode is proportional to the difference between the velocity output from the joy stick 310 and a speed signal $V_{sp}$ indicative of the actual car velocity as determined by the swash plate angle. In the position mode, the output of summing junction 320 is a position error signal so that the output of the summing junction 322 in the position mode is proportional to the difference between the position error signal and the speed signal. As the desired position is achieved the position error signal (or velocity output in the velocity mode) entering summing junction 322 is zero. The output of summing junction 322 then outputs a command telling the car to stop the summing junction at 320, acting as a first comparator means, thus receives the position signal and the position output for producing a position error signal indicative of the difference between the position output and the position signal. The second summing junction 322, acting as a second comparator means, receives the speed signal, the velocity output and the position error signal to produce an actuating signal $A_C$. The actuating signal $A_C$ is indicative of the difference between the speed signal and the velocity output in the velocity mode, and it is indicative of the difference between the speed signal and the position error in the position mode. The output of summing junction 322 is an actuating signal $A_C$ which controls the position of the stroking pistons which control the swash plate angle in the hydraulic pump 167. Since the swash plate angle is proportional to the velocity of the car, the actuating signal signal $A_C$ is proportional to the velocity of the car.

In the automatic skinning mode the position of the car C is automatically controlled instead of being controlled by the joy stick 310. Accordingly, mode select switch 302 enables circuit 324 in the automatic skinning mode which generates the actuating signal $A_C$ as a function of the car position, the desired car speed, the end limits and the actual speed of the car as determined by the sensor 266 (FIG. 4) or the swash plate feedback signal $V_{SP}$. The car position is determined by the car position signal $C_X$ from the position sensor 270 (FIG. 4) and the end limits are determined by circuit 328 in accordance with the left and right limits $L_L$, $R_L$ in the memory circuits 272, 274 (FIG. 4). An offset may be added to the end limits to cause the ends of the workpiece to travel beyond the grinding wheel 100. The offset is selected from offset select device 330 which may be a conventional digital selecting device manually actuated by thumb wheels. Thus, if the workpiece is to be reciprocated beneath the grinding wheel with the grinding wheel overshooting the ends of the workpiece by one foot, the offset selector will be preset to the one foot value the actuating signal $A_C$ thus corresponds to the difference between the position indication as provided by the workpiece position sensing means and the modified left position limit when the grinding head is moving toward the left end of the workpiece. The actuating signal $A_C$ corresponds to the difference between the position indication as provided by the workpiece sensing means and the modified right position limit when the grinding head is moving toward the right edge of the workpiece. Consequently, the workpiece WP reciprocates beneath the grinding wheel with the grinding wheel traveling beyond the ends of the workpiece. The desired speed is also determined from an external input device 332. The car speed signals, namely, the swash plate position signal $V_{SP}$ and the car velocity signal $V_X$ are received from the pump 167 and rotational velocity sensor 266, respectively. Although the swash plate position signal $V_{SP}$ and the car speed signal $V_X$ are approximately equal to each other under steady state conditions, it has been found that their time related characteristics differ significantly. The swash plate signal $V_{SP}$ is proportional to the magnitude which the system attempts to cause the car to move while the car speed signal $V_X$ is proportional to the actual car speed. The differences between the signals are principally due to the delays caused by the elasticity of the car drive cable and other structural members as well as the delays inherent in fluid control devices. It has been found that under steady state conditions between the ends of the workpiece the swash plate feedback signal $V_{SP}$ is more advantageously utilized while near the ends of the workpiece the car speed signal $V_X$ is more advantageously utilized. Thus as the car reciprocates beneath the grinding wheel the car velocity is relatively constant until the wheel reaches a predetermined distance from the ends of the workpiece at which point the car begins to decelerate. The swash plate position signal $V_{SP}$ is also used instead of the car velocity signal $V_S$ in the manual spotting and manual skinning modes by applying it to the negative input of the summing junction 322 since it has been found that the stability of this technique is substantially better than utilizing the car speed signal $V_X$.

A block diagram for the vertical axis control system for the grinding wheel is illustrated in FIG. 5B. In the manual spotting mode the vertical position of the grinding wheel 100 is controlled by the head control joy stick 314 for producing a command signal which is received by command circuits 340, 346. The actual magnitude of the grinding action of the grinding wheel 100 on the workpiece WP is measured by a grinding action sensing means, which may be a torque transducer 344, which produces a grinding action feedback signal. A comparator 342 is enabled by the enable circuit 316 in the manual spotting mode, and it determines whether the actual magnitude of the grinding action as measured by torque transducer 344 is above a predetermined minimum value. If the actual grinding action is below the preset value thereby indicating that the grinding wheel 100 is not yet in contact with the workpiece the comparator 342 enables circuit 340 so that the output of the joy stick 314 is applied directly to the grinder head control valve output $C_y$. If the actual grinding action measured by the transducer 344 is above the preset value the comparator 342 enables comparator 345 which determines if the actual grinding action is greater than a maximum grinding action preset by selector 347. If actual grinding action does not exceed maximum grinding action the comparator 345 enables command circuit 346 to apply the output of the head control joy stick 314 to a torque command bus 348. If the actual grinding action exceeds the preset maximum torque command, circuit 351 is actuated to apply a maximum torque signal to the torque command bus 348. Thus, in the manual spotting mode, the command signal on bus 348 is the output of the vertical head control joy stick 314 limited to a maximum value. As explained hereinafter the command signal adjusts the grinding force so that the actual grinding action equals the grinding action command. Thus, in the manual spotting mode the grinding wheel 100 moves vertically at a velocity proportional to the position of the joy stick 314 until the grinding wheel 100 makes contact with the workpiece WP at which time the position of the joy stick 314 controls the grinding action of the grinding wheel 100 against the workpiece WP.

As mentioned above, when the control mode select switch 302 is switched into the standby mode from any of the other modes detection circuit 304 actuates command circuit 308 which produces a signal at the grinder head control valve output $C_y$ to raise the grinding wheel 100 a fixed distance. The vertical position of the grinding wheel 100 is measured by a position sensor 309 thereby allowing the circuit 308 to determine when the grinding wheel 100 has been raised the predetermined distance. In any of the modes the enable circuit 316 applies the output of the head control joy stick 314 to circuit 350 so that the grinding wheel 100 can be raised from the workpiece WP by a command signal generated by circuit 350 on the grinder head control valve output $C_y$.

In the manual skinning and automatic skinning modes the vertical position of the grinding wheel 100 is automatically controlled. Basically, the grinder head control output $C_y$ is equal to a pressure error signal which is proportional to the difference between a pressure command and the pressure $P_U$ in the upper section of the cylinder 120 as measured by pressure sensor 135 (FIG. 1). The pressure command is determined by the sum of a grinding torque error signal and a calculated command, both of which are a function of the command signal on bus 348. The calculated command is indicative of the grinding force exerted by the grinding wheel 100 on the workpiece WP which is expected to produce a grinding action equal to the command signal. The motor torque error signal is proportional to the difference between the command signal and the actual grinding action as measured by the torque transducer 344. Although a variety of grinding action transducers may be utilized, a load pin torque transducer mounted on one of the drive components for the grinding wheel 100 may be advantageously used.

In the manual and automatic skinning modes, the grinding action is automatically controlled. Accordingly, comparator 360 is enabled by circuit 316 in either of these modes. Comparator circuit 360 compares $C_X$ indicative of the actual position of the car with the right and left hand limits $R_L$, $L_L$. If the car position is within the right and left hand limits, the comparator circuit 360 enables torque command generator 362. If the car position is not within the right and left hand limits the comparator circuit 360 enables a comparator 361 which determines if the actual grinding action as measured by transducer 344 is above a preset value. If the actual grinding action is less than the predetermined value the comparator 361 generates a headhold actuating signal which actuates a hold command generating circuit 366 which prevents the system from generating a control signal $C_{y4}$ on the grinder head control valve so that the grinding wheel 100 is held at its current position. This circuitry is thus a grinding head locking means for maintaining the vertical position of the grinding wheel 100 constant responsive to the headhold actuating signal, thereby causing the grinding wheel 100 to produce a uniform depth-of-cut at the ends of the workpiece WP. The end limits $R_L$, $L_L$ are generally set to values corresponding to a car position where the grinding wheel is adjacent the ends of the workpiece. Under these circumstances the actual grinding action will not exceed the predetermined value when the car position is beyond the end limits since the grinding wheel is unable to contact the workpiece WP. However, where only a portion of the workpiece is being conditioned in the automatic skinning mode the grinding wheel 100 will be above the workpiece WP when the car C carries the ends of the workpiece WP beyond the grinding wheel. In this case it is possible for the surface of the workpiece to rise toward the grinding wheel. If the grinding wheel 100 is held in position the maximum grinding action will be quickly exceeded possibly damaging the grinding wheel. Consequently, the system raises the grinding wheel 100 in this instance. Accordingly, a second comparator means 361 compares the actual grinding action, as indicated by the grinding action feedback signal from the transducer 344, with a predetermined value. The second comparator means 361 overrides the head locking means to move the grinding wheel 100 away from the workpiece WP responsive to the grinding action exceeding the predetermined value. Accordingly, the mode select switch 302(*b*) is switched to the standby mode thereby raising the grinding wheel 100 through circuits 304, 308. When the command generator 362 is enabled by circuit 360, it produces a command signal which is a function of several variables. The command generator 362 of FIG. 5B thus functions as a command signal generating means from which a torque error signal and a pressure error signal is derived. The command signal produced by circuit 362 is a predetermined function of the car speed signal $V_X$ from the rotational velocity sensor 266 (FIG. 4) as well as a manual input from a torque load selector 368. The torque load selector 368, which is a conventional digital input device, basically determines the amount of work performed by the grinding wheel 100 during each grinding pass. The command signal from the output of circuit 362 is applied to the torque command bus 348 along with the outputs of circuits 346 and 351.

The command signal on the command buss 348 is applied to a positive input of summing junction 371 through amplifier 372. The other positive input to the summing junction 371 receives the output of compensating circuit 373 which calculates the proper pressure command for maintaining the grinding wheel 100 in a stationary position above the workpiece for a zero command signal. The calculated pressure command is thus equal to the pressure command adjusted to compensate for the weight of the grinding head. The command on the torque command bus 348 is also applied to the positive input to summing junction 370. The negative terminal of the summing junction 370 receives the actual grinding action feedback signal from the torque transducer 344. The output of the summing junction 370 is thus a grinding action error signal equal to the difference between actual grinding action and the command signal. The grinding action error signal is applied to a command error generator 374 through amplifier 375. The command error generator 374 produces a command error equal to the product of the grinding action error signal and the amplified command signal. The command error from the command error generator 374 and the calculated command from the summing junction 371 are combined by summing junction 376 acting as a summing means to produce a pressure command indicative of the pressure in the upper section of the cylinder 120 required to produce a grinding action equal to the command signal. The pressure command is thus a signal which is indicative of the pressure in the upper section of the cylinder expected to achieve the desired magnitude of grinding action. The pressure command is feedback signal $P_U$ in the upper section of the cylinder by a summing junction 377 to produce a pressure error signal. The pressure $P_u$ is thus a pressure feedback signal indicative of the force exerted by the grinding wheel 100 against the workpiece and it is proportional to the difference between the pressure command and the pressure feedback signal. The pressure error signal is received by a comparator 378 which determines if the pressure is negative and larger than a preset limit determined by pressure limit selector 380. If the pressure error is not a negative value larger than the limit, the control signal $C_y$ from the summing junction 377 is applied to the hydraulic fluid control means 131 (FIG. 1) through amplifier 379. If the pressure error is a negative value larger than the limit the pressure error is applied through circuit 381 to the output $C_y$ if a pressure limit mode has not been selected at mode selector 383, while a head raise command circuit 385 is actuated to raise the grinding wheel 100 if the pressure limit mode has been selected. Thus the pressure error is applied to the output $C_y$ if the pressure limit mode has not been selected. If the pressure limit mode has been selected the pressure error is applied to the output $C_y$ to adjust the grinding force to provide a grinding action equal to the command signal until the pressure error limit has been exceeded at which point the head is raised at a fixed rate. The above-described structure is thus a signal processing means and a calculating means which receives the command signal, the grinding action feedback signal and the pressure feedback signal for generating a grinding action error signal which is proportional to the difference between the command signal and the grinding action feedback signal. It also generates a pressure command signal corresponding to the command signal indicative of the pressure in the cylinder expected to achieve the desired magnitude of grinding action. It further produces a pressure error signal which is proportional to the difference between the pressure command signal and the pressure feedback signal and it adds the grinding action error signal and the pressure error signal to each other to produce the control signal. It will be understood that insofar as the signal processing means is a linear system, the order of the summations and comparisons can be varied without departing from the scope of the invention.

The limit set selector 380 may be used to select a fairly light limit. In the past, grinding control systems which applied a relatively light grinding force to the workpiece were incapable of accurately following irregular workpiece contours. By attempting to apply a relatively high grinding force to the workpiece and then limiting the maximum grinding force to a fairly light value, the grinding system is capable of accurately following irregular workpiece contours even though the grinding force is relatively light. In operation in the pressure limit mode, when a relatively light grinding force is selected through the limit set selector 380 the actual grinding force will oscillate about the preset limit. As the grinding wheel 100 first touches the workpiece WP the pressure error force quickly overshoots the limiting value causing the circuit 378 to actuate circuit 385 and raise the grinding wheel 100 at a preset rate. Very shortly thereafter the pressure error falls below the preset limit causing the circuit 378 to apply the pressure error to the output $C_y$ once again increasing the pressure in the upper section of the cylinder 120.

As illustrated in FIG. 5C, in any of the modes other than standby the head traverse joy stick 312 is powered by the control mode select switch 302. If the automatic skinning mode has been selected, indexing circuit 392 is enabled to selectively produce an index command as determined by a manually adjusted index selector 394. The indexing circuit 392 receives a position feedback signal from a head transverse position transducer 396 which may be a potentiometer, encoder or similar device mounted on the pivotal connection between the cylinder 108 and frame 110 (FIG. 1). The indexing circuit 392 then generates an index command on the grinder head traverse control output $V_Z$ when the car has reached the limits of its reciprocating travel as indicated by a signal received from circuit 328 or at any position of the car travel as desired. If the selector 302 is not in the automatic skinning mode, the output of the joy stick 312 is applied to circuit 398 which generates a signal on the head traverse control valve output $V_Z$ which is proportional to the position of the joy stick. The output $V_Z$ is monitored by actuating circuit 400 which set the locking cylinders 123 or other braking device when a traverse command is not present and releases the braking device when a traverse command is present.

We claim:

1. In a grinding machine for conditioning the surface of an elongated workpiece, said machine having a grinding wheel rotatably mounted on a movable grinding head, longitudinal actuating means for providing relative reciprocating movement between said grinding wheel and said workpiece along the longitudinal axis of said workpiece, and transverse actuating means for providing incremental transverse movement between said grinding wheel and said workpiece, a grinding machine control system, comprising:

a hydraulic cylinder having first and second longitudinally spaced fluid ports;

a piston slidably received in said cylinder thereby dividing said cylinder into first and second sections communicating, respectively, with said first and second fluid ports, said piston including a rod projecting from one end of said cylinder with said cylinder and rod connected between said grinding head and a fixed anchor to move said grinding wheel normal to the surface of said workpiece as said piston moves in said cylinder;

bias means for maintaining the pressure in the first section of said cylinder substantially constant;

hydraulic fluid control means connected to said second fluid port for selectively causing hydraulic fluid to flow into and out of the second section of said cylinder responsive to a control signal;

command signal generating means for selecting a command signal corresponding to a desired magnitude of grinding action of said grinding wheel on said workpiece;

pressure sensing means for measuring the pressure in the second section of said cylinder to produce a pressure feedback signal indicative of the force of said grinding wheel against said workpiece in a direction normal to the surface of said workpiece;

grinding action sensing means for producing a grinding action feedback signal indicative of the actual magnitude of grinding action of said grinding wheel on said workpiece;

signal processing means receiving said command signal, said grinding action feedback signal and said pressure feedback signal for generating a grinding action error signal which is proportional to the difference between said command signal and said grinding action feedback signal, a pressure command signal corresponding to said command signal indicative of the pressure in the second section of said cylinder expected to achieve said desired magnitude of grinding action, and a pressure error signal which is solely proportional to the difference between said pressure command signal and said pressure feedback signal; and summing means for adding said grinding action error signal and said pressure error signal to produce said control signal such that said control signal is a function of both the deviation of the actual magnitude of the grinding action from a target value and solely the deviation of the actual grinding force from a target value.

2. The grinding machine of claim 1 wherein said bias means comprises an hydraulic accumulator communicating with the first section of said cylinder.

3. The grinding machine of claim 2 further including accumulator pressure sensing means for producing an accumulator pressure signal indicative of the pressure in said accumulator and wherein said signal processing means receives said accumulator pressure signal and calculates the difference between said pressure feedback signal and said accumulator pressure signal in order to generate said control signal as a function of the force exerted by said piston.

4. The grinding machine of claim 3 wherein said accumulator pressure sensing means is mounted in said accumulator such that said accumulator pressure signal is indicative of the average pressure in the first section of said cylinder.

5. In a grinding machine for conditioning the surface of an elongated workpiece, said machine having a grinding wheel rotatably mounted on a movable grinding head, longitudinal actuating means for providing relative reciprocating movement between said grinding wheel and said workpiece along the longitudinal axis of said workpiece, and transverse actuating means for providing incremental transverse movement between said grinding wheel and said workpiece perpendicular to the longitudinal axis of said workpiece, a grinding machine control system, comprising:

hydraulic actuating means for producing a grinding action between said grinding wheel and said workpiece in a direction normal to the surface of said workpiece responsive to a control signal;

command signal generating means for selecting a command signal corresponding to a desired magnitude of grinding action of said grinding wheel on said workpiece;

calculating means for generating said control signal from said command signal so that said hydraulic actuating means causes the grinding action of said grinding wheel on said workpiece to be substantially equal to said desired magnitude of grinding action;

a position transducer producing a position signal indicative of the position of said workpiece with respect to said grinding wheel along the longitudinal axis of said workpiece;

position memory means for recording as first and second end limits the position of said workpiece when said grinding wheel is adjacent a pair of spaced apart points thereof;

comparator means receiving said position signal and said end limits for producing an actuating signal when said position signal indicates that said grinding wheel is outside of said end limits;

grinding head locking means operatively associated with said hydraulic actuating means for maintaining the position of said grinding wheel toward and away from said workpiece constant responsive to said actuating signal thereby causing said grinding wheel to produce a uniform depth-of-cut at the ends of said workpiece; and means for producing a grinding action feedback signal indicative of the actual magnitude of grinding action; and second comparator means for overriding said head locking means to move said grinding wheel away from said workpiece responsive to said grinding action feedback signal exceeding a predetermined value.

6. The grinding machine control system of claim 5 further including means for producing a grinding action feedback signal indicative of the actual magnitude of grinding action, and comparator means for overriding said head hold means to move said grinding wheel away from said workpiece responsive to said grinding action feedback signal exceeding a predetermined value.

7. In a grinding machine for conditioning the surface of an elongated workpiece, said machine having a grinding wheel rotatably mounted on a movable grinding head, longitudinal actuating means for providing relative reciprocating movement between said grinding wheel and said workpiece along the longitudinal axis of said workpiece responsive to an actuating signal, and transverse actuating means for providing incremental transverse movement between said grinding wheel and said workpiece perpendicular to the longitudinal axis of said workpiece, a grinding machine control system, comprising:

hydraulic actuating means for producing a grinding action between said grinding wheel and said workpiece in a direction normal to the surface of said workpiece responsive to a control signal;

command signal generating means for selecting a command signal corresponding to a desired magnitude of grinding action of said grinding wheel on said workpiece;

calculating means for generating said control signal from said command signal so that said hydraulic actuating means causes the grinding action of said grinding wheel on said workpiece to be substantially equal to said desired magnitude of grinding action;

a position transducer providing a position signal indicative of the position of said grinding wheel with respect to said workpiece along the longitudinal axis of said workpiece;

a speed transducer providing a speed signal indicative of the velocity of said grinding wheel with respect to said workpiece along the longitudinal axis of said workpiece;

manual control means for producing a manipulation signal which is proportional to the position of a control lever;

manually actuated mode switch for switching said manipulation signal between a position output and a velocity output in either a position mode or a velocity mode, respectively;

first comparator means receiving said position signal and said position output for providing a position error signal indicative of the difference between said position output and said position signal; and second comparator means receiving said speed signal, said velocity output and said position error signal for producing said actuating signal indicative of the difference between said speed signal and said velocity output in said velocity mode and the difference between said speed signal and said position error in said position mode.

8. In a grinding machine for conditioning the surface of an elongated workpiece, said machine having a grinding wheel rotatably mounted on a movable grinding head, and transverse actuating means for providing incremental transverse movement between said grinding wheel and said workpiece perpendicular to the longitudinal axis of said workpiece, a grinding machine control system, comprising:

hydraulic actuating means for producing a grinding action between said grinding wheel and said workpiece in a direction normal to the surface of said workpiece responsive to a control signal;

command signal generating means for selecting a command signal corresponding to a desired magnitude of grinding action of said grinding wheel on said workpiece; and calculating means for generating said control signal from said command signal so that said hydraulic actuating means causes the grinding action of said grinding wheel on said workpiece to be substantially equal to said desired magnitude of grinding action;

means for manually working said grinding wheel with respect to said workpiece along the longitudinal axis of said workpiece between right and left ends responsive to an actuation signal;

workpiece position sensing means for providing a workpiece position indication corresponding to the relative position between said workpiece and said grinding wheel along the longitudinal axis of said workpiece;

left limit position memorizing means for storing a left position limit;

right limit position memorizing means for storing a right position limit;

offset select means for adding a preset offset to said right and left position limits to generate modified right and left position limits, respectively; and workpiece position comparing means for generating said actuation signal corresponding to the difference between said position indication as provided by said workpiece position sensing means and said modified left position limit when said grinding head is moving toward the left end of said workpiece, and corresponding to the difference between said position indication as provided by said workpiece position sensing means and said modified right position limit when said grinding head is moving toward the right end of said workpiece such that said workpiece reciprocates beneath said grinding wheel with said grinding wheel traveling beyond the ends of said workpiece.

9. The grinding machine control system of claim 8 further including head hold means for producing a uniform depth-of-cut at the ends of said workpiece, comprising grinding head locking means for maintaining the position of said grinding wheel toward and away from said workpiece constant when said position sensing means indicates that said grinding wheel is between said left position limit and said modified left position limit and between said right position limit and said modified right position limit.

* * * * *